United States Patent [19]

Bayless

[11] Patent Number: 4,776,108

[45] Date of Patent: Oct. 11, 1988

[54] LEG REST FOR ORTHOPEDIC SHOE

[76] Inventor: James D. Bayless, 412 S. Bellaire, Kansas City, Mo. 64123

[21] Appl. No.: 77,502

[22] Filed: Jul. 24, 1987

[51] Int. Cl.[4] ..... A43B 7/00

[52] U.S. Cl. ..... 36/1 R; 36/132

[58] Field of Search ..... 36/1, 103, 110, 132, 36/136, 81; 297/423, 438, 439; 248/118, 188.5, 359 E; 128/80 R-80 J, 84

[56] References Cited

U.S. PATENT DOCUMENTS

| | | | |
|---|---|---|---|
| 32,490 | 6/1861 | Towers | 36/136 |
| 2,290,445 | 7/1942 | Oleyar | 36/1 |
| 2,844,143 | 7/1958 | Swanson | 128/84 R |
| 3,695,684 | 10/1972 | Barberg | 297/438 |
| 3,696,826 | 10/1972 | Gruzalski | 297/439 |
| 3,704,850 | 12/1972 | Hendrickson et al. | 248/188.5 |
| 3,980,409 | 9/1976 | Turner | 248/188.5 |
| 4,546,557 | 10/1985 | Barook et al. | 36/81 |
| 4,642,910 | 2/1987 | Carter, Jr. et al. | 36/1 |
| 4,677,767 | 7/1987 | Darby | 36/110 |
| 4,693,022 | 9/1987 | Terhune | 36/136 |

FOREIGN PATENT DOCUMENTS

| | | | |
|---|---|---|---|
| 546178 | 2/1932 | Fed. Rep. of Germany | 248/188.5 |

*Primary Examiner*—Steven N. Meyers

*Attorney, Agent, or Firm*—John A. Hamilton

[57] ABSTRACT

An elevating leg rest assembly or a shoe to be worn by a user when either necessity or comfort requires that his foot and leg be supported in a position elevated above the floor when he is seated, the leg rest assembly consisting of a sheath extending longitudinally of the shoe, and having one or more leg sections normally telescoped into aid sheath to permit normal walking movements, but which may be extended rearwardly of the sheath to adjustably variable distances whereby to support the user's foot and leg in an elevated position above the floor when the user is seated. The sheath may be permanently encased within the thick and rigid soles of certain types of orthopedic shoes, or may be disposed at one side of the shoe and be rigidly but detachably mounted to a rigid portion of the shoe.

8 Claims, 1 Drawing Sheet

LEG REST FOR ORTHOPEDIC SHOE

This invention relates to new and useful improvements in orthopedic shoes, and has particular reference to a leg rest which may be either built into or attached to such a shoe.

BACKGROUND OF THE INVENTION

Many persons who undergo orthopedic operations on the foot may, in the recuperative stage, be allowed to walk, so as to avoid more complete incapacitation, so long as they wear a special orthopedic shoe for protection, and also use crutches, walkers or such other equipment which may be indicated in their particular circumstances. One very common feature of such shoes is that the shoe sole is thick, stiff and rigid, in order to either inhibit or to completely prevent flexure of the foot itself, in the event the user has experienced bone fractures or sinew or ligament damage. One difficulty commonly experienced by such persons is that while they may be able to walk with the aid of the special shoe and such other supports as may be necessary, they suffer considerable throbbing pain in the foot and leg while in a sitting position if the foot is allowed to rest at floor level. Also, if they have also undergone injury or surgery requiring immobilization of the knee, they may be unable to lower the foot to the floor. Much of the pain, in the first instance, can be alleviated by maintaining the foot in a position elevated well above the floor, and in the second instance, such elevation is of course required at all times. If the person is relatively active, and moves about from place to place with considerable frequency, the desirability or necessity of finding a support for elevating the foot above the floor when in a sitting position presents considerable problems. A suitable support may in many cases simply not be available, and even if available may not be of precisely the desired height. A special leg rest which is built into or attached to the shoe itself, and hence is always available for use whenever needed, would obviously be a useful device having wide applicability under many varying circumstances.

SUMMARY OF THE INVENTION

Accordingly, the principal object of the present invention is the provision of a leg rest adapted to be mounted in or on a shoe, which may be collapsed into substantial longitudinal registration with the length of the shoe, so that it will not materially interfere with the walking motions of the person wearing the shoe, but which whenever desired may be extended rearwardly from the heel of the shoe and locked in position at any desired degree of extension, so that its extended end will engage the floor to support the user's foot in a position elevated above the floor when he is in a seated position.

Another object is the provision of a leg rest of the character described wherein said rest comprises a plurality of relatively telescoping sections, whereby said leg rest when collapsed may still be disposed substantially within the longitudinal extent of the shoe, but may be extended to a length substantially greater than the length of the shoe, to support the user's foot at a still greater elevation.

A further object is the provision of a leg rest of the character described which provides contact points with the floor which are spaced apart laterally of the shoe, whereby to provide lateral stability for the user's foot when supported thereby.

A still further object is the provision of a leg rest of the character described which, when collapsed, is largely contained and concealed within the thick, rigid sole of the orthopedic shoe, when the leg rest is applied to such a shoe.

A still further object is the provision of a leg rest of the character described which, when collapsed, extends along one side of the shoe, and has means for mounting it operably on nearly any shoe.

Other objects are simplicity and economy of structure, and ease and convenience of use.

DESCRIPTION OF A PREFERRED EMBODIMENT

Figure 1:
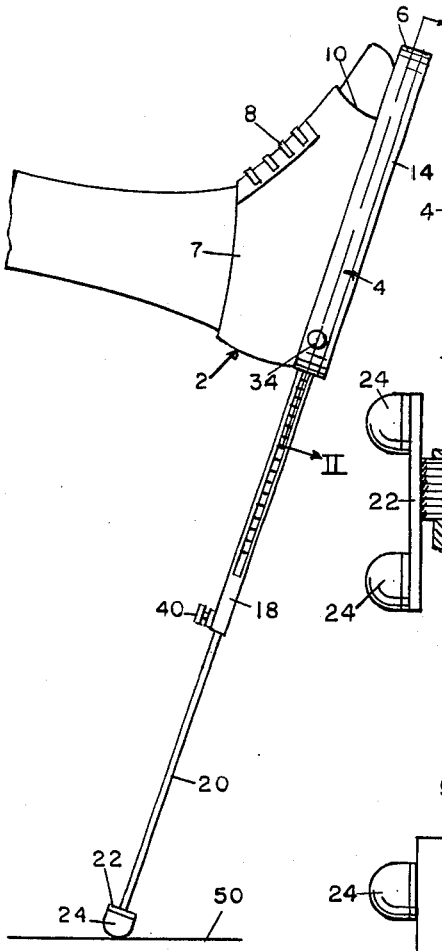
FIG. 1 is a side elevational view of an orthopedic shoe having a leg rest embodying the present invention mounted operably thereon and shown in a use position, the leg rest being fully extended.

Like numerals apply to similar parts throughout the several views, and the numeral 2 applies generally to an orthopedic shoe having a thick, rigid sole 4, formed usually of wood or a lightweight plastic, said sole having a protective covering 6 of suitable sheet material. The shoe upper 7 may be of substantially ordinary form, being secured to the foot by a shoelace 8, except that the toe portion of the upper is often cut away, as indicated at 10, to provide freedom of movement for the user's toes. The shoe may also be provided with an insole 12, although this is not pertinent to the present invention. The lower surface of sole 4 may have a thin rubber pad 14 covering and affixed thereto, to provide non-skid traction with the floor or ground.

Figure 3:
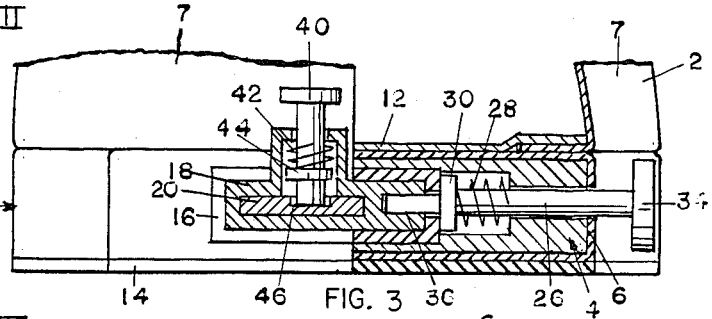
FIG. 3 is an enlarged, fragmentary sectional view taken on line III—III of FIG. 2.
Figure 2:
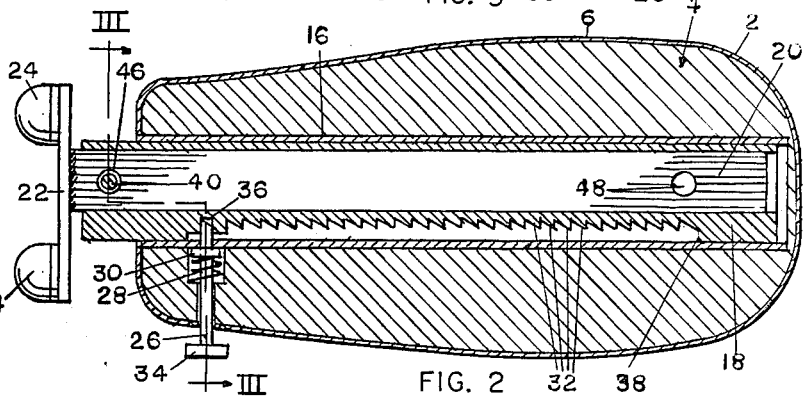
FIG. 2 is an enlarged sectional view taken on line II—II of FIG. 1, with the leg rest fully retracted.

The leg rest forming the subject matter of the present invention, in the form thereof shown in FIGS. 1–3, includes a strong metal sheath 16 of rectangular cross-sectional contour extended through the rigid sole 4 of the shoe and permanently affixed therein. Said sheath extends substantially the full length of the sole, from its forward to its rearward end, and opens through the rearward end thereof. Said sheath serves as a receptable for the leg rest members themselves, as will be described. It does not weaken the sole, but in fact actually strengthens it. A second sheath 18, which serves as a first extensible leg member, and which is also of rectangular cross-sectional contour, is disposed slidably within sheath 16, and a solid bar member 20, which serves as a second extensible leg member is disposed slidably within sheath 18. When both extensible leg members are fully retracted, as shown in FIG. 2, sheath 18 extends slightly to the rear of sheath 16, and bar 20 extends slightly to the rear of sheath 18. Affixed to the rearward end of bar 20 is a transversely extending foot bar 22, to which a pair of rubber foot members 24 are affixed. Said foot members are spaced apart transversely of the shoe, but should both be disposed within the rearwardly extended transverse width of the shoe itself, in order not to interfere with normal walking movements of the user.

The movement of sheath 18 in sheath 16 is controlled by a ratchet pin 26 disposed horizontally and laterally, extending slidably in a bore provided therefor in sole 4 adjacent the shoe heel, and outwardly from the side of the sole. Said ratchet pin is biased inwardly by a spring 28 which bears against a flange 30 of the pin. The pin extends inwardly through an aperture provided therefor in the side of sheath 16, and cooperates at its inner end with a series of ratchet teeth 32 formed in a side edge surface of sheath 18. As the sheath 18 is moved rearwardly, teeth 32 ratchet over the inner end of the ratchet pin, but the pin, as long as it engages the teeth, locks sheath 18 against forward movement. Sheath 18 may be moved forwardly only after the ratchet pin is released by manually pulling a knob 34 at its outer exposed end outwardly to free said pin from said teeth. The inner end of the ratchet pin is beveled to cooperate with the teeth. In FIG. 2 it will be seen that sheath 18 is provided at the rearward end of teeth 32 with a blind socket 36, such that when the ratchet pin is engaged therein, sheath 18 is locked against movement in either direction, when said sheath is in its fully retracted, forwardmost position, so that said sheath cannot be moved at all until the ratchet pin is manually retracted. The flange 30 of the pin may be non-circular, and engaged non-rotatably in the recess of the sole in which it moves, in order to maintain the beveled inner end of the pin in properly oriented relation to teeth 32. Sheath 18 is provided at the forward end of the series of teeth 32 with a shoulder 38, which engages the ratchet pin to arrest the rearward movement of said sheath with enough of said sheath still engaged in sheath 16 to insure rigidity of sheath 18 when it is extended from sheath 16 to the extent allowed by shoulder 38.

The movement of bar 20 in sheath 18 is controlled by a latch pin 40 similar to ratchet pin 26, pin 40 extending vertically at the rearward end of sheath 18, which still extends sufficiently from sheath 16 for this purpose even when sheath 18 is fully encased in sheath 16. Pin 40 is biased downwardly by a spring 42 bearing against a flange 44 of the pin, its lower end being engageable in a socket 46 formed in the top surface of bar 20 adjacent its rearward end, whereby to lock the bar against movement in sheath 18 when said bar is at its forwardmost position in said sheath. The bar is provided adjacent its forward end with a second socket 48 for receiving pin 40 when pin 40 is retracted upwardly and the bar moved rearwardly to as great an extent as is consistent with the retention by said bar of normal rigidity when it is fully extended. The bar could of course be equipped with any desired number of sockets disposed intermediate sockets 46 and 48.

In the operation of the species of the invention thus far described, when a user wearing a shoe as described sits down, and desires that his foot and leg be elevated, either by necessity if his knee is immobilized, or to alleviate pain or discomfort, he may raise latch pin 40 to elevate it from socket 46 of bar 20, and slide said bar rearwardly in sheath 18 until the pin again snaps into engagement with socket 48, so that bar 20 is locked in its fully extended position. The user may then elevate his foot, whereupon foot members 24 engage the floor 50 to support his leg and foot in an elevated position. The laterally spaced apart relation of the two foot members 24 impart lateral stability to the elevated foot and leg, so that the user does not have to exert constant muscular force to maintain his foot and leg from "overturning" to one side or the other. If the elevation obtained by the extension of only bar 20 is insufficient for the requirements of that particular user in his own particular circumstances, he may disengage ratchet pin 26 from blind socket 36 by pulling outwardly on knob 34 of said pin, and extend sheath 18 slidably from sheath 16, continuing said movement with the pin ratcheting over teeth 32 until the composite "leg" formed by sheath 18 and bar 20 is of the length to provide the desired elevation of the user's foot and leg. Teeth 32 are quite closely spaced, in order that the adjustment may be finely divided. If, on the other hand, the leg elevation provided by the extension of bar 20 from sheath 18 is too great in any particular case, the user may return bar 20 to a position fully encased in sheath 18, and sheath 18 extended from sheath 16 as already described, so that the full elevation provided by the composite leg is derived solely from the latter extension. In other words, the full extension of both sheath 18 from sheath 16, and the extension of bar 20 from sheath 18, may be accomplished in increments equal to the spacing between two successive teeth 32 of sheath 18.

While an adult user may seldom require extension of both of the leg sections, a child user usually will. The legs of a child often do not reach the floor when he is seated on a chair of adult height, so that the leg forming the subject matter of this invention must be extended to a greater length to reach the floor when his foot is raised by straightening the leg. Also, since the composite leg when collapsed must be disposed substantially within the length of the shoe, and since the child's shoe is of course shorter than an adult shoe, a shoe of the present type constructed for children's use may require more than the two extensible leg sections shown. Three, four or even more extensible leg sections could be used within the purview of the present invention.

DESCRIPTION OF A MODIFIED EMBODIMENT

Figure 4:
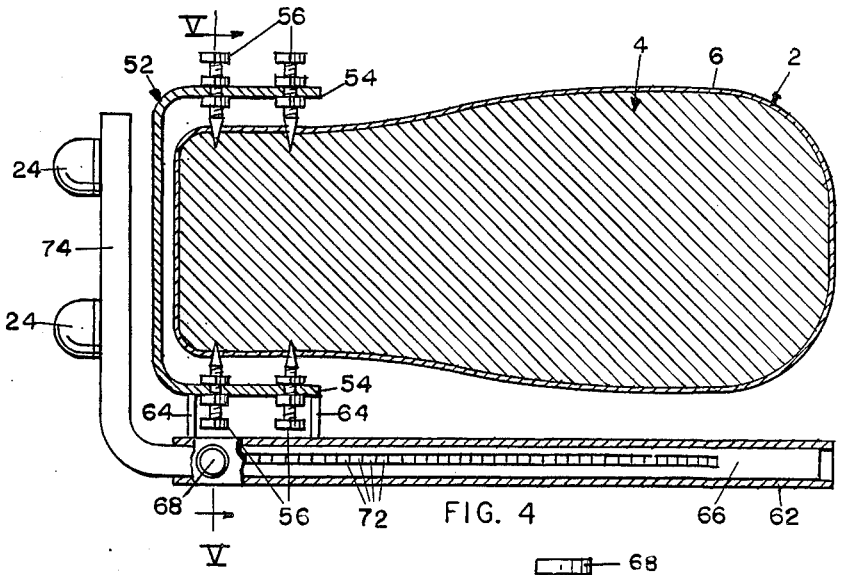
FIG. 4 is a view similar to FIG. 2, but showing a modified form of construction, being a somewhat irregular reduced sectional view taken on line IV—IV of FIG. 5.
Figure 5:
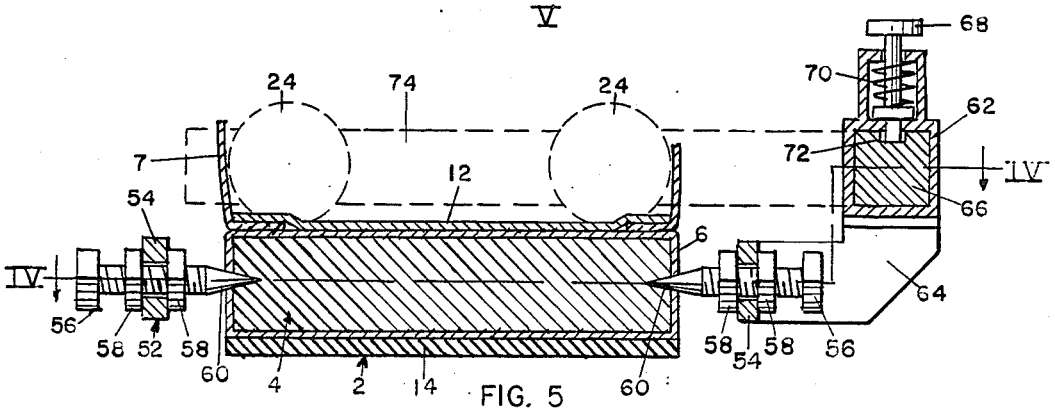
FIG. 5 is an enlarged sectional view taken on line V—V of FIG. 4.

The modified structure shown in FIGS. 4 and 5 is similar in many respects to the preferred embodiment shown in FIGS. 1–3, corresponding parts being denoted by corresponding numerals, except that the leg is mounted externally of the shoe, not inside of the sole 4. The modified embodiment includes a rigid, U-shaped mounting bracket 52 which is adapted to be disposed to bridge the heel portion of sole 4 transversely and horizontally, with the generally parallel arm portions 54 thereof extending forwardly along the sides of said heel portion. Each bracket arm 54 has a pair of spaced apart bolt members 56 secured rigidly but adjustably therein by a pair of lock nuts 58. Said bolt members also extend horizontally and laterally relative to the shoe, and the inner end of each is sharpened to provide a penetrating point 60 adapted by proper adjustment of the lock nuts to be driven into substantial penetration into the side of the sole 4, whereby the bracket is mounted rigidly on the shoe heel. A tubular sheath 62, shown as of square cross-sectional contour, is arranged at one side of the shoe, and extends horizontally the full length of the shoe, in spaced relation above the bottom of the shoe sole. For obvious reasons, the sheath 62 should be placed at the "outside" of the shoe, that is, at the right side of a right shoe, or at the left side of a left shoe. The sheath is rigidly affixed to bracket 52 by a pair of arms 64 extending between and welded to said sheath and to one of the side arms 54 of the bracket. Sheath 62 serves the function of sheath 16 of FIGS. 1–3, but is of course not mounted inside of the sole 4. A square bar 66 is disposed for sliding movement within sheath 62, and its movement therein is controlled by a ratchet pin 68 carried at the rearward end of the sheath and biased downwardly by a spring 70 to engage operatively in any one of a continuous series of ratchet teeth 72 formed longitudinally in the top surface of the bar. If functions in the same manner as ratchet pin 26 of FIGS. 1–3. Rearwardly of the rearward end of sheath 62, bar 66 is bent at right angles to form a foot bar 74 extending horizontally and transversely behind the shoe when bar 66 is at its forwardmost position in the sheath. The rubber feet 24 are mounted on bar 74.

Operation of the modified embodiment is much the same as that of the preferred embodiment, upward manual release of ratchet pin 68 against the bias of spring 70 allowing the rearward extension of bar 66 from sheath 62 to serve as a leg for supporting the user's foot and leg in an elevated position above the floor. While not shown, it is again apparent that a plurality of relatively telescoping leg sections could be substituted for the single bar 66 actually shown, within the purview of the invention. This modified embodiment also has certain other advantages. Firstly, it may be readily demounted from the shoe itself when its use is not necessary or desired. Secondly, since it does not require that the shoe sole be rigid and relatively thick, it may be mounted on other types of shoes, even those having flexible soles. Many types of shoes, even ordinary stree shoes having flexible soles, have soles the rearward or heel portions of which are sufficiently thick and rigid, being formed for example of multiple laminations of stiff leather, to serve readily as an adequate mounting for the sharpened ends of the screw members 56 of the mounting assembly of the modified structure.

What I claim as new and desire to protect by Letters Patent is:

1. In combination with a shoe adapted to be worn on the foot of a person requiring or desiring that said foot be supported in a position elevated above the floor when he is in a sitting position, a leg rest assembly comprising:

a. a sheath member rigidly mounted relative to said shoe, extending substantially the full length of the shoe, above the floor-engaging surface of the shoe sole, and opening rearwardly of the shoe, b. a leg member carried for longitudinal sliding movement in said sheath member, so as to be extendable rearwardly from said shoe, and c. locking means operable to lock said leg member against forward movement into said sheath member when the former is in an extended position, whereby the rearward end of said leg member is positioned to engage the floor to support the user's leg and foot in a position elevated above the floor when the user is in a seated position, and d. a foot member fixed relatively to the rearward end of said leg member, said foot member including a pair of floor-engaging members spaced apart transversely of the width of said shoe, whereby to provide lateral stability to the user's foot when it is supported in an elevated position.

2. The combination as recited in claim 1 wherein said floor-engaging members are formed of a material providing non-skid engagement with the floor surface.

3. In combination with a shoe adapted to be worn on the foot of a person requiring or desiring that said foot be supported in a position elevated above the floor when he is in a sitting position, a leg rest assembly comprising:

a. a sheath member rigidly mounted relative to said shoe, extending substantially the full length of the shoe, above the floor-engaging surface of the shoe sole, and opening rearwardly of the shoe, b. a leg member carried for longitudinal sliding movement in said sheath member, so as to be extendable rearwardly from said shoe, and c. locking means operable to lock said leg member against forward movement into said sheath member when the former is in an extended position, whereby the rearward end of said leg member is positioned to engage the floor to support the user's leg and foot in a position elevated above the floor when the user is in a seated position, d. said locking means comprising a ratchet pin spring loaded for movement relative to said sheath member to engage selectively in any of a series of ratchet notches formed therefor in a lateral edge of said leg member, whereby to permit free rearward ratcheting movement of said leg member relative to said sheath member, but not to permit forward movement of said leg member in said sheath, said ratchet pin being manually releasable from said notches to permit forward movement of said leg member.

4. In combination with a shoe adapted to be worn on the foot of a person requiring or desiring that said foot be supported in a position elevated above the floor when he is in a sitting position, a leg rest assembly comprising:

a. a sheath member rigidly mounted relative to said shoe, extending substantially the full length of the shoe, above the floor-engaging surface of the shoe sole, and opening rearwardly of the shoe, b. a leg member carried for longitudinal sliding movement in said sheath member, so as to be extendable rearwardly from said shoe, and c. locking means operable to lock said leg member against forward movement into said sheath member when the former is in an extended position, whereby the rearward end of said leg member is positioned to engage the floor to support the user's leg and foot in a position elevated above the floor when the user is in a seated position, d. said first-named leg member being tubular in form, and with the addition of a second leg member movable slidably within said first leg to extend rearwardly from the rearward end thereof, and means operable to lock said second leg member releasably against sliding movement in said first leg member at either extended or non-extended positions relative to said first leg member.

5. The combination as recited in claim 4 wherein said locking means comprises a latch pin carried by said first leg member transversely of said second leg member, and spring-loaded to engage selectively in any of a plurality of sockets provided therefor in said second leg member at longitudinally spaced apart points therealong, said latch pin being manually disengageable from said sockets to permit unrestricted sliding movement of said second leg member in said first leg member.

6. The combination as recited in claim 5 with the addition of a foot member affixed to the rearward end of said second leg member, said foot member including a pair of floor-engaging members spaced apart transversely of the width of said shoe, whereby to provide lateral stability to the user's foot when it is supported in an elevated position.

7. In combination with a shoe adapted to be worn on the foot of a person requiring or desiring that said foot be supported in a position elevated above the floor when he is in a sitting position, a leg rest assembly comprising:

a. a sheath member rigidly mounted relative to said shoe, extending substantially the full length of the shoe, above the floor-engaging surface of the shoe sole, and opening rearwardly of the shoe, b. a leg member carried for longitudinal sliding movement in said sheath member, so as to be extendable rearwardly from said shoe, and c. locking means operable to lock said leg member against forward movement into said sheatch member when the former is in an extended position, whereby the rearward end of said leg member is positioned to engage the floor to support the user's leg and foot in a position elevated above the floor when the user is in a seated position d. said sheath member extending longitudinally along one side of said shoe, in elevated relation above the floor-engaging surface of the sole of the shoe, and with the addition of means for mounting said sheath rigidly to a rigid portion of said shoe.

8. The combination as recited in claim 7 wherein said mounting means comprises:

a. a rigid, U-shaped bracket operable to bridge a rigid portion of the heel of the shoe sole horizontally, b. a plurality of transversely extending screws carried by said bracket at each side of said shoe heel, said screws being pointed at the ends thereof toward said heel, and being adjustable relative to said bracket whereby their pointed ends may be caused to penetrate into said heel to mount said bracket rigidly relative to said heel, and c. means connecting said bracket rigidly to said sheath member.

* * * * *